United States Patent [19]

Asano

[11] Patent Number: 4,799,398

[45] Date of Patent: Jan. 24, 1989

[54] SAFETY DEVICE FOR CONTROL LEVER OF CONSTRUCTION MACHINES

[75] Inventor: Akio Asano, Kuki, Japan

[73] Assignee: Mikasa Sangyo Co., Ltd., Japan

[21] Appl. No.: 144,802

[22] Filed: Jan. 13, 1988

Related U.S. Application Data

[63] Continuation-in-part of Ser. No. 6,463, Jan. 16, 1987, abandoned.

[30] Foreign Application Priority Data

Jun. 10, 1986 [JP] Japan ..... 61-087214

[51] Int. Cl.[4] ..... G05G 7/00; E01C 19/26

[52] U.S. Cl. ..... 74/473 R; 74/491; 74/531; 180/19.1; 180/272; 188/67; 404/122

[58] Field of Search ..... 74/473 R, 474, 491, 74/531; 180/271, 272, 19.1, 19.3; 188/67; 403/104; 404/117, 122; 267/150

[56] References Cited

U.S. PATENT DOCUMENTS

| | | | |
|---|---|---|---|
| 2,641,430 | 6/1953 | Secofsky et al. | 403/104 X |
| 3,313,174 | 4/1967 | Walker et al. | 74/474 |
| 3,525,266 | 8/1970 | Brooks et al. | 74/474 X |
| 3,693,474 | 9/1972 | Trick | 74/491 X |
| 3,792,744 | 2/1974 | Gray | 74/491 X |
| 3,814,531 | 6/1974 | Carnahan et al. | 404/117 |
| 4,267,804 | 5/1981 | Rypka | 180/271 X |
| 4,356,738 | 11/1982 | Shuler et al. | 74/473 R X |
| 4,573,543 | 3/1986 | Ba Taille | 180/19.1 |
| 4,629,020 | 12/1986 | Thurman | 180/19.3 X |
| 4,660,730 | 4/1987 | Holmes | 74/491 X |

FOREIGN PATENT DOCUMENTS

| | | | |
|---|---|---|---|
| 2428784 | 2/1980 | France | 404/122 |

*Primary Examiner*—Allan D. Herrmann
*Attorney, Agent, or Firm*—Darby & Darby

[57] ABSTRACT

A safety device for the control lever of a construction machine having hydrostatic transmission which comprises a casing provided on the machine and a control rod rotatably connected at one end thereof with the control lever associated with the hydrostatic transmission, said control rod being formed with a slender portion at the other end portion which is slidably accommodated by the casing, said slender portion having a coil spring interposed within the casing, and said coil spring being stressed sufficiently to automatically return the control lever to the neutral position when the operator takes his hands off the control lever.

3 Claims, 3 Drawing Sheets

SAFETY DEVICE FOR CONTROL LEVER OF CONSTRUCTION MACHINES

RELATED APPLICATION

This application is a continuation in part of copending U.S. patent application Ser. No. 006,463 filed Jan. 16, 1987, now abandoned.

FIELD OF THE INVENTION

This invention relates to a safety device for the control lever of construction machines such as a pedestrian-type road roller or a compactor having a hydrostatic transmission. The safety device of the present invention prevents said construction machines from running away.

BACKGROUND OF THE INVENTION

The above construction machines are driven by an operator, while the operator is walking. The machines have a possibility of running away, in case the operator tumbles over and cannot control it any more or in case he turns on the starter with the control lever keeping at the forward or backward position.

To solve the above problem, a conventional machine has been equipped with the safety device as shown in FIG. 5. The safety device comprises a control box 20, a control lever 30, a safety rod 40, and a safety arm 50. The control lever 30 is swingably supported by an axis in the control box 20. The safety rod 40 is slidably supported on the rear wall of the control box 20 and extends from the outside through the inside of the rear wall. The safety rod 40 interposes a stressed coil spring 41 in the housing 42. The upper portion of the control lever 30 is adjacent to the end of the safety rod 40 inside the control box 20 when the lever 30 is shifted to the backward position as indicated by dashed line. The safety arm 50 has a V-like shape and is pivotally supported at the corner of the V-like shape by an axis in the lower portion of the control box 20 adjacent to the front wall of the control box 20. The upper portion of the safety arm 50 inwardly extends in the control box 20. The lower end of the control lever 30 is adjacent to the upper portion of the safety arm 50 when the lever 30 is shifted to the backward position as indicated by dashed line. The lower portion of the safety arm 50 extends from the bottom to the outside of the control box 20. In case the operator is sandwiched between an obstacle and the machine moving backwardly, pushing the safety rod 40 changes the position of the control lever 30 to the neutral or forward position and then keeps the operator safe. In case the operator tumbles over and cannot operate the control lever, pushing the safety arm 30 changes the position of the control lever 30 to the neutral or forward position and then keeps the operator safe.

However the above-mentioned conventional safety device requires the operator to immediately touch another portion than the control lever 30, that is, the safety rod 40 or the safety arm 50, in order to prevent the machine from running away. If the operator unfortunately has no chance to touch such portions, it is impossible to stop the machine running away. Moreover, the safety rod 40 and the safety arm 50 are encumbrances for ordinary operations, since they extend out of the control box 20. And such structure is complicated and large, and makes the manufacturing cost expensive.

U.S. Pat. No. 4,267,804 issued to Rypka discloses a safety system which prevents a construction machine from being turned on unless the control lever is in a neutral position, thereby making the operator reminded to place the control lever in the neutral position before attempting to start the machines. Rypka provides a solution to prevent accidents which occur when the machine is started, but does not give the solution to prevent accidents which occur while the machine is in operation, e.g. when the operator in operation tumbles over.

SUMMARY OF THE INVENTION

The present invention provides a safety device which is adapted to a construction machine having hydrostatic transmission which normally comprises fluid pressure pump and hydraulic motor. The safety device according to the present invention comprises a casing and a control rod. The control rod is slidably accommodated in the casing and extends from the inside through the outside of the casing. The control rod is rotatably connected at the end extending outside of the casing with an end of the control lever. The control rod has a slender portion where a stressed coil spring is interposed. The control lever connectes with and controls the fluid pressure pump of the hydrostatic transmission. The coil spring is stressed sufficiently to have the control lever to automatically return to the neutral position where no fluid is supplied with the fluid pressure pump, when an operator takes his hand off the control lever.

According to a preferred embodiment, the coil spring is provided at both ends thereof with washers. Each washer engages with each engaging portion formed on the interior wall of the casing because of the force of the stressed coil spring so that the control rod may return to the neutral position when the operator takes his hands off the control lever.

It is an object to provide a safey device which automatically makes the control lever return to the neutral position only if the operator takes his hands off the lever, thereby stopping the movement of the machine.

It is another object to provide a safety device which is simple in structure, small-sized, easy to manufacture and low in cost.

According to the present invention, all the operator has to do in case of an accident is only to take his hands off the control lever. Even if the operator tumbles over or is sandwiched between an obstacle and the machine, the operator do not have to handle any portion of the machine.

DESCRIPTION OF THE PREFERRED EMBODIMENT

Hereinafter, the present invention is more particularly set forth with reference to the accompanying drawings wherein preferred embodiments are shown.

Figure 1:
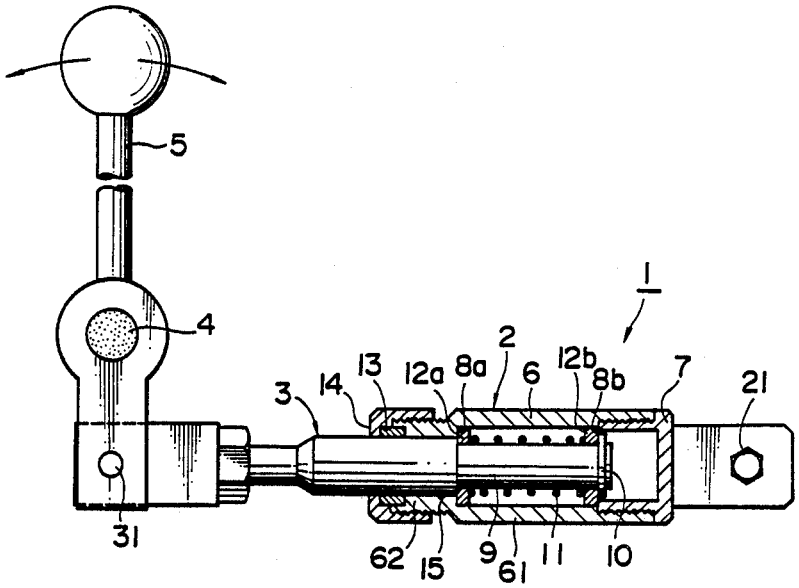
FIG. 1 is a sectional view of a preferred embodiment of the safety device of the present invention in the neutral position.

In FIG. 1, the numeral 1 generally indicates a inventive safety device which automatically returns the control lever from the forward or backward position to the neutral position. The device 1 includes a casing and a control rod, which are generally indicated at 2 and 3, respectively. The casing 2 is rotatably connected at the forward end 21 thereof with an appropriate portion of the body of a construction machine. The control rod 3 is slidably inserted into the casing 2. The rearward end 31 of the control rod 3 which extends out of the casing, is rotatably connected to the lower end of the control lever 5. The control lever 5 is rotatably supported by an axis 4.

The casing 2 comprises a cylindrical member 6 and a cap member 7. The cylindrical member 6 consists of a wide portion 61 and a narrow portion 62. The connecting portion of the wide portion 61 and the narrow portion 62 forms a rear engaging portion 8*a* inside the cylindrical member 6. The cap member 7 is threadably mounted into the cylindrical member 6 and has an inner diameter smaller than that of the wide portion 61 so that the rim of the cap member forms a forward engaging portion 8*b* inside the cylindrical member 6.

The control rod 3 has a forward slender portion 9. The slender portion 9 forms a step portion 15 of the rod 3 and is provided at the end thereof with a snap ring 10. In the slender portion 9, a stressed coil spring 11 is interposed between the snap ring 10 and the step portion 15. The stressed coil spring 11 is provided at both ends thereof with washers 12*a* and 12*b*, each of which engages with the snap ring 10 and the step portion 15. The control lever 5 is connected with the control rod 3 so as to be in the neutral position when the washers 12*a* and 12*b* engage with the engaging portions 8*a* and 8*b* respectively.

The control rod 3 is provided therearound adjacent to the rear end of the cylindrical member 6 with an annular friction member 13 made of such material as urethane rubber and is provided adjacent to the friction member 13 with an adjusting ring 14 which covers the friction member 13. The adjusting ring 14 is threadably connected with the cylindrical member 6. Rotation of the adjusting ring 14 varies the slide speed of the control rod 3 depending on the pressure of the friction member 13 to the control rod 3.

Figure 2:
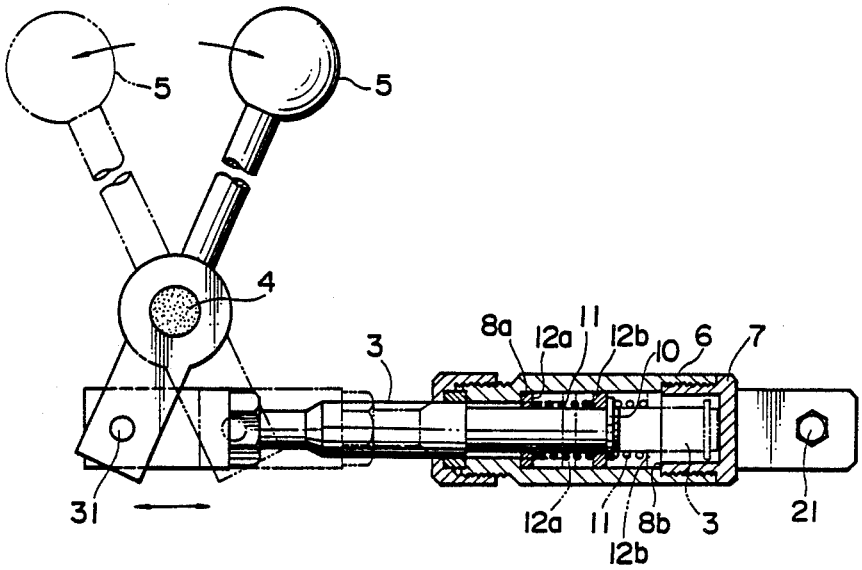
FIG. 2 is a sectional view of the preferred embodiment of the safety device of the present invention in the forward and backward position drawn by full line and dashed line, respectively.

As best shown in FIG. 2, when the control lever 5 is positioned in the forward direction as drawn by full line, the lower end of the control lever 5 moves backwardly around the axis 4 and actuates the control rod 3 backwardly. At this time, the washer 12*a* engages with the engaging portion 8*a* and the washer 12*b* moves backwardly while engaging with the snap ring 10 and compressing the coil spring 11 between the washers 12*a* and 12*b*. On the other hand, when the control lever 5 is positioned in the rearward direction as drawn by dashed line, the lower end of the control lever 5 moves forwardly around the axis 4 and actuates the contorl rod 3 forwardly. At this time, the washer 12*b* engages with the engaging portion 8*b* and the washer 12*a* moves forwardly while engaging with the step portion 15 and compressing the coil spring 11 between the washers 12*a* and 12*b*. In the latter position of the control lever 5, if the operator is sandwiched between the machine and an obstacle behind him or tumbles over, he only has to take his hands off the control lever 5, and the control lever 5 automatically returns to the neutral position shown in FIG. 1 thanks to the resilience of the spring coil 11 so that the machine stop.

Figure 3:
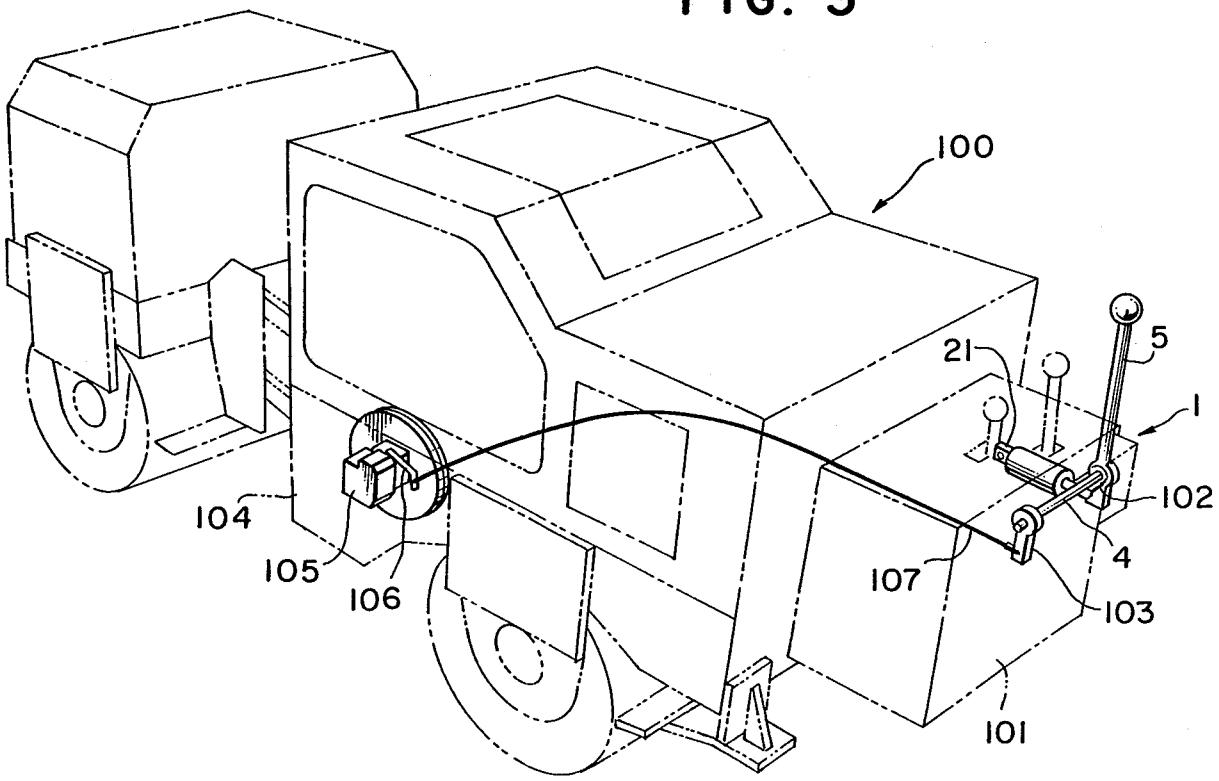
FIG. 3 is a diagramatical perspective view of a pedestrian-type road roller which is equipped with the safety device of FIG. 1.

FIG. 3 diagramatically shows a pedestrian-type vibrarion roller 100 having a hydrostatic transmission, which is connected with the safety device 1 according to the present invention. The safety device is mounted with a bolt 21 on a flange in the control box 101 of the roller 100. The control lever 5 is fixed at one end of the shaft 4 which is rotatably supported on a bearing 102 within the control box 101. An arm 103 is fixed with bolts and the like on the other end of the shaft 4. And, the arm 103 is connected via a wire 107 having a guide tube to the lever 106 of the fluid pressure pump 105 which varies the amount and the direction of fulid to be supplied with the hydraulic motor. Thus, when the control lever 5 is in forward or backward position as shown in FIG. 2, the hydrostatic transmission drives the machine in a foward or backward direction by way of the control lever 5, the shaft 4, the arm 103, the wire 107 and the lever 106.

Figure 4:
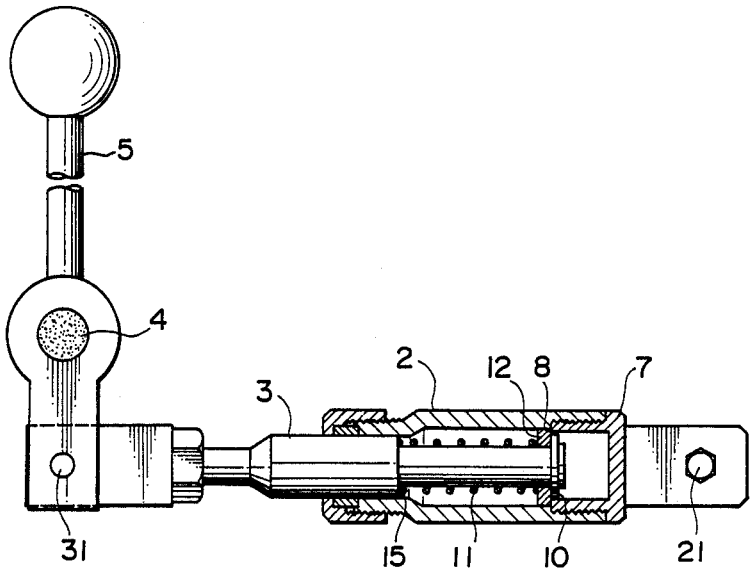
FIG. 4 is a sectional view of another preferred embodiment of the safety device of the present invention in the neutral position.
Figure 5:
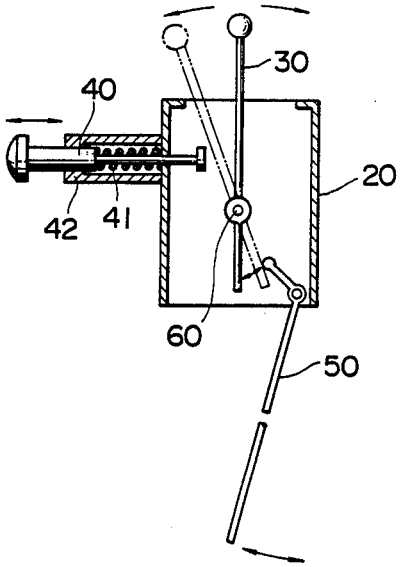
FIG. 5 PRIOR ART
FIG. 5 is a sectional view of the conventional safety device.

Even if the operator tumbles over or is sandwiched between the roller and an obstacle during the operation of the roller 100 of FIG. 4, all the operator has to do to stop the roller is to take his hands off the control lever 5. Because, only if he takes his hands off, the control lever 5 automatically returns to the neutral position by virtue of the stressed coil spring 11 and places the lever 106 at the position where no fluid is pumped to the hydraulic motor by way of the wire 107, thereby stopping the movement of the roller 100.

FIG. 4 shows another embodiment of the safety device according to the present invention. Of course, the safety device of FIG. 4 can be applied to the roller of FIG. 3 in place of the safety device of FIG. 1. In FIG. 3, the numerals denote the members corresponding to FIGS. 1 and 2. This embodiment has the same structure as the embodiment of FIGS. 1 and 2, except that the coil spring 11 has a washer 12 adjacent to the snap ring 10 and the other end of the coil spring 11 directly engages with the step portion 15 of the control rod 3. When the control lever 5 is positioned in the backward direction, the lower end of the control lever 5 moves forwardly around the axis 4 and actuates the control rod 3 forwardly. At this time, the washer 8 engages with the rim 8 of the cap member 7 while the coil spring 11 is compressed between the portion 15 and the washer 12. At the above state, if the operator takes his hands off the control lever 5, the control lever 5 automatically returns to the neutral position thanks to the resilience of the coil spring 11. However, when the control lever 5 is positioned in the forward direction, this embodiment does not allow the control lever 5 to return to the normal position automatically. It is understood that the embodiment of FIG. 3 is designed to ensure the safety only during the backward drive and is, therefore, suitable to attain an efficient work.

It should be understood that the inventor intend to cover by the appended claims all modifications falling within the true spirit and scope of the present invention.

What is claimed is:

1. A safety device for the control lever of a construction machine having hydrostatic transmission which comprises:

a casing provided on the machine;

a control rod which is rotatably connected at one end portion thereof with the control lever associated with the hydrostatic transmission of the machine, said control rod being formed with a slender portion at the other end portion which is slidably accommodated by the casing, and said slender portion having a snap ring at the end thereof; and a coil spring which is interposed on the slender portion, said coil spring being provided at each end thereof with a washer;

said casing being provided on the inner wall thereof with each engaging portion which engages with each of said washers, and said coil spring being stressed within the casing sufficiently to automatically return the control lever to neutral position; and, wherein said control rod is provided at the end of the casing with an annular friction member and is provided adjacent to the friction member with an adjusting member covering the friction member, said adjusting member being threadably mounted on the casing so that rotation of the adjusting member varies the slide speed of the control lever depending on compression of the friction member.

2. A safety device for the control lever of a construction machine having hydrostatic transmission which comprises a casing provided on the machine;

a control rod which is rotatably connected at an end portion thereof with the control lever associated with the hydrostatic transmission of the machine, said control rod being formed with a slender portion at the other end portion which is slidably accomodated by the casing, and said slender portion having a snap ring at the end thereof; and a coil spring which is interposed on the slender portion, said coil spring being provided at the end thereof with a washer;

said casing being provided on the inner wall thereof with an engaging portion which engages with said washer, and said coil spring being stressed within the casing sufficiently to automatically return the control lever to neutral position.

3. A safety device for the control lever of a construction machine having hydrostatic transmission which comprises:

a casing provided on the machine;

a control rod which is rotatably connected at an end portion thereof with the control lever associated with the hydrostatic transmission of the machine, said control rod being formed with a slender portion at the other end portion which is slidably accommodated by the casing, and said slender portion having a snap ring at the end thereof; and a coil spring which is interposed on the slender portion, said coil spring being provided at the end thereof with a washer;

said casing being provided on the inner wall thereof with an engaging portion which engages with said washer, and said coil spring being stressed within the casing sufficiently to automatically return the control lever to neutral position; and wherein said control rod is provided at the end of the casing with an annular friction member and is provided adjacent to the friction member with an adjusting member covering the friction member, said adjusting member being threadably mounted on the casing so that rotation of the adjusting member varies the slide speed of the control lever depending on compression of the friction member.

* * * * *